US007856832B2

(12) United States Patent
Lim et al.

(10) Patent No.: US 7,856,832 B2
(45) Date of Patent: Dec. 28, 2010

(54) REFRIGERATOR WITH SUPERCOOLED BEVERAGE DISPENSER AND METHOD FOR CONTROLLING THE SAME

(75) Inventors: Chang Hak Lim, Hwasung-si (KR); Yong Han Kim, Cheonan-si (KR); Jeong Han Kim, Suwon-si (KR); Young Shik Shin, Seongnam-si (KR); Won Jae Yoon, Seoul (KR); Jae Seung Lee, Hwaseong-Gun (KR); Hye Ran Lee, Goonpo-Si (KR); Jung Soo Lim, Seoul (KR); Joo Young Ha, Seoul (KR); Kyung Hee Hahm, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 0 days.

(21) Appl. No.: 12/461,961

(22) Filed: Aug. 28, 2009

(65) Prior Publication Data

US 2009/0314012 A1 Dec. 24, 2009

Related U.S. Application Data

(62) Division of application No. 11/482,040, filed on Jul. 7, 2006, now Pat. No. 7,596,964.

(30) Foreign Application Priority Data

Jan. 14, 2006 (KR) ..... 2006-4200

(51) Int. Cl.
*F25C 1/00* (2006.01)

(52) U.S. Cl. ..... 62/66; 62/340; 62/348; 62/389; 222/146.6

(58) Field of Classification Search ..... 62/66, 62/74, 340, 347, 348, 389
See application file for complete search history.

(56) References Cited

U.S. PATENT DOCUMENTS 2,706,385 A * 4/1955 Topping ..... 62/233

(Continued)

FOREIGN PATENT DOCUMENTS

JP 5-153953 * 6/1993

(Continued)

OTHER PUBLICATIONS

U.S. Appl. No. 11/482,040, filed Jul. 7, 2006, Chang Hak Lim, et al., Samsung Electronics Co., Ltd.

(Continued)

*Primary Examiner*—Frantz F Jules
*Assistant Examiner*—Daniel C Comings
(74) *Attorney, Agent, or Firm*—Staas & Halsey LLP

(57) ABSTRACT

A refrigerator that allows a user to receive supercooled beverage through a dispenser in the refrigerator door. The refrigerator includes a main body having a compartment and a door opening and closing the compartment, a supercooling compartment in the main body to supercool a beverage, and a dispenser in the door to dispense supercooled liquid from the supercooling compartment without opening the door. A supercooled liquid tank is detachably installed in the supercooling compartment to supercool beverage. The supercooling compartment is installed in the rear side of the door such that a supercooling compartment door may be installed in the front side of the door to open and close the supercooling compartment in front of the door.

4 Claims, 13 Drawing Sheets

U.S. PATENT DOCUMENTS

| | | | | |
|---|---|---|---|---|
| 2,728,203 | A | 12/1955 | King | |
| 3,638,392 | A | 2/1972 | Welker et al. | |
| 3,659,429 | A | 5/1972 | McLean | |
| 4,368,622 | A | 1/1983 | Brooks | |
| 4,543,799 | A | 10/1985 | Horvay et al. | |
| 4,732,009 | A * | 3/1988 | Frohbieter | 62/382 |
| 5,511,388 | A | 4/1996 | Taylor et al. | |
| 5,542,265 | A | 8/1996 | Rutland | |
| 6,375,834 | B1 | 4/2002 | Guess et al. | |
| 2003/0097314 | A1 | 5/2003 | Crisp et al. | |
| 2003/0211219 | A1 | 11/2003 | Scullion et al. | |

FOREIGN PATENT DOCUMENTS

| | | |
|---|---|---|
| JP | 2003-214753 | 7/2003 |

OTHER PUBLICATIONS

Official Action issued by the Russian Patent Office (3 pgs.) English translation (2 pgs.).

English translation of Chinese Patent Office Action, mailed Jun. 6, 2008 and issued in corresponding Chinese Patent Application No. 200610108090.1.

Office Action mailed Nov. 20, 2008 in parent U.S. Appl. No. 11/482,040.

Office Action mailed Jan. 9, 2009 in parent U.S. Appl. No. 11/482,040.

Notice of Allowance mailed Jun. 15, 2009 in parent U.S. Appl. No. 11/482,040.

* cited by examiner

REFRIGERATOR WITH SUPERCOOLED BEVERAGE DISPENSER AND METHOD FOR CONTROLLING THE SAME

CROSS-REFERENCE TO RELATED APPLICATIONS

This application is a divisional of application Ser. No. 11/482,040 filed Jul. 7, 2006 now U.S. Pat. No. 7,596,964 and claims the benefit of Korean Patent Application No. 2006-4200, filed on Jan. 14, 2006, in the Korean Intellectual Property Office, the disclosure of which is incorporated herein by reference.

BACKGROUND OF THE INVENTION

1. Field of the Invention

The present invention relates to a refrigerator, and more particularly, to a refrigerator from which supercooled beverage is supplied through a dispenser installed in a door.

2. Description of the Related Art

A refrigerator is an apparatus for supplying chilled air generated in a refrigerating cycle to a compartment such that a variety of food is maintained fresh for a long time. When temperature of the compartment is adjusted properly, beverages can be maintained in a supercooled state, and a user can use the supercooled beverage to make a beverage not completely frozen or not completely melted (hereinafter, referred to as 'slush').

Although the beverage is generally changed to a solid phase when its temperature is under its freezing point temperature at standard atmospheric pressure, occasionally, the beverage is not changed into the solid phase but is maintained in the supercooled state. As such, if liquid is not frozen even when it is below the freezing point and remains in the supercooled state it is in what is known in thermodynamics as in a metastable state. Since the supercooled liquid in the metastable state is neither unstable nor stable, when there is ambient perturbation, the supercooled beverage undergoes a phase transition to the solid state. Thus, when either a shock or vibration is applied to the supercooled beverage or an ice nucleus such as ice is inserted into beverage in the supercooled state, the beverage can be changed into the slush in which liquid and solid are mixed.

In connection with this, recently a supercooling apparatus capable of supercooling beverage and of maintaining the same in supercooled state is proposed. As an example, Japanese Laid-Open Patent Publication No. 2003-214753 discloses a supercooling apparatus installed in a main body of a refrigerator such that the temperature of a compartment for accommodating food is uniform and food is refrigerated. However, since conventional research is focused on precise control of the compartment in view of controlling the supercooling apparatus or in view of structure, it is lacking in that a user can make slush beverages conveniently.

Naturally, if the supercooled beverage is prepared, the user can make the slush beverage in various ways without serious effort. For example, there may be various ways of putting ice serving as an ice nucleus into the supercooled beverage contained in a vessel or of shaking and impacting a sealed vessel containing the supercooled beverage. However, the former has a disadvantage of preparing ice independent from supercooling the beverage, and the latter has a disadvantage that a user cannot make as much as desired slush from the supercooled beverage.

Further, since the conventional supercooling apparatus must open a door thereof for taking out the supercooled beverage, a large quantity of chilled air in the compartment must be discharged out of the refrigerator whenever the user makes the slush beverage. In a point of view that temperature of the compartment is precisely controlled for the supercooling of the beverage, loss of the chilled air lowers the performance of the supercooling apparatus.

SUMMARY OF THE INVENTION

The present invention has been made in view of the above-mentioned problems, and an aspect of the invention is to provide a refrigerator in which a user can take out a supercooled beverage in the refrigerator without opening the door by using a dispenser installed in a door.

It is another aspect of the present invention to provide a refrigerator in which a user can be provided with an ice nucleus necessary to change a supercooled liquid into slush through a dispenser to allow the user to more conveniently make a slush beverage.

In accordance with one aspect, the present invention provides a refrigerator including a main body having a compartment and a door for opening and closing the compartment; a supercooling compartment provided in the main body to supercool a beverage; and a dispenser installed in the door to dispense a supercooled liquid in the supercooling compartment without opening the door.

The refrigerator may further include an ice supply device installed in the main body such that a user receives ice through the dispenser.

The supercooling compartment includes a supercooled liquid tank for accommodating the beverage in the supercooled state, wherein the supercooled liquid tank is detachably installed.

The supercooling compartment may accommodate a beverage container containing the beverage when the supercooled liquid tank is removed.

Moreover, the supercooling compartment is provided in the rear side of the door. The door includes a supercooling compartment door installed in the front side of the door to open and close the supercooling compartment in front of the door.

The refrigerator further includes a supercooled liquid discharge pipe for discharging the supercooled liquid in the supercooled liquid tank to the dispenser.

Moreover the refrigerator further includes a first water supply pipe for connecting a water source to the supercooled liquid tank to supply water into the supercooled liquid tank. The first water supply pipe includes a pre-refrigerating part for accommodating the water supplied from the water source and pre-refrigerating the water.

The refrigerator further includes a second water supply pipe having an end communicated with the first water supply pipe and the opposite end extended to the dispenser.

The supercooled liquid discharge pipe may include a discharge valve for opening and closing the supercooled liquid discharge pipe, and the first and the second water supply pipes respectively have a first water supply valve and a second water supply valve for opening and closing the first and the second water supply pipes.

The dispenser includes at least one lever installed for the user to take out the water, the supercooled liquid, and the ice.

The refrigerator further includes a controlling unit for controlling the dispenser, and the controlling unit includes a mode selector for selecting material to be taken out through the dispenser by a user.

The refrigerator further includes a slush mode in which the supercooled liquid and the ice are taken out through the dispenser.

Meanwhile, the supercooling compartment includes a chilled air introducing port through which the chilled air in the compartment is introduced into the supercooling compartment.

The compartment includes a freezer compartment and a refrigerator compartment, and the refrigerator further including a mixing room provided in the main body to suction the chilled air from the freezer compartment and the refrigerator compartment and to mix the chilled air.

The mixing room includes a first suction port for suctioning the freezer compartment chilled air, a second suction port for suctioning the refrigerator compartment chilled air, and a chilled air discharge port for discharging chilled air mixed in the mixing room into the supercooling compartment.

The supercooling compartment is provided in the rear side of the door and the mixing room is provided in the compartment such that the chilled air discharge port communicates with the chilled air introducing port when the door is closed.

The supercooling compartment further includes an accommodating room for accommodating the supercooled liquid tank, and a chilled air circulation room disposed outside the accommodating room and having a chilled air introducing port formed at a side thereof such that the accommodating room is indirectly refrigerated through the chilled air in the chilled air circulation room.

The accommodating room further includes a chilled air injection port communicated with the chilled air circulation room, and in the chilled air injection port, a damper is installed to open and close the chilled air injection port.

In accordance with another aspect, the present invention provides a refrigerator including a main body having a compartment for freezing and refrigerating food and a door for opening and closing the compartment, a supercooling compartment provided in the main body to supercool a beverage and having a temperature range different from that of the compartment, and a dispenser installed in the door to receive a supercooled liquid in the supercooling compartment without opening the door.

In accordance with another aspect, the present invention provides a refrigerator including a main body having a compartment and a door for opening and closing the compartment; a supercooling compartment including a supercooled liquid tank provided in the main body to supercool a beverage; a dispenser installed in the door to dispense a supercooled liquid in the supercooling compartment without opening the door; an ice supply device installed in the main body to supply ice to the dispenser; and a controlling unit for controlling the dispenser and the ice supply device.

The refrigerator further includes a first mode in which the supercooled liquid and the ice are discharged from the dispenser.

The ice supply device includes an icing unit for generating ice cubes, an ice container for accommodating the ice cubes generated in the icing unit, a shattering unit for shattering the ice cubes in the ice container into ice segments, and a discharge unit for selectively discharging the ice cubes and the ice segments. The controlling unit controls the discharge unit to discharge the ice segments in the first mode.

The refrigerator further includes a second mode in which the supercooled liquid is discharged through the dispenser, a third mode in which cool water is discharged, and a fourth mode in which the ice is discharged.

In accordance with another aspect, the present invention provides a refrigerator including In accordance with another aspect, the present invention provides a controlling method of a refrigerator for supercooling a beverage including selecting a slush mode according to a command by a user, and making a slush by taking out a supercooled liquid and ice according to the selected slush mode.

The making the slush includes taking out the supercooled liquid from a supercooling compartment and taking out the ice from an ice supply device after taking out the supercooled liquid, or taking out the ice from an ice supply device and taking out the supercooled liquid from a supercooling compartment after taking out the ice.

In accordance with another aspect, the present invention provides a controlling method of a refrigerator for supercooling a beverage including selecting a slush mode according to a command by a user, taking out a supercooled liquid from a supercooling compartment according to the selected supercooled liquid mode, and making a slush by taking out ice from an ice supply device according to the command by the user.

Additional aspects and/or advantages of the invention will be set forth in part in the description which follows and, in part, will be apparent from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings in which.

DETAILED DESCRIPTION OF THE PREFERRED EMBODIMENTS

Figure 1:
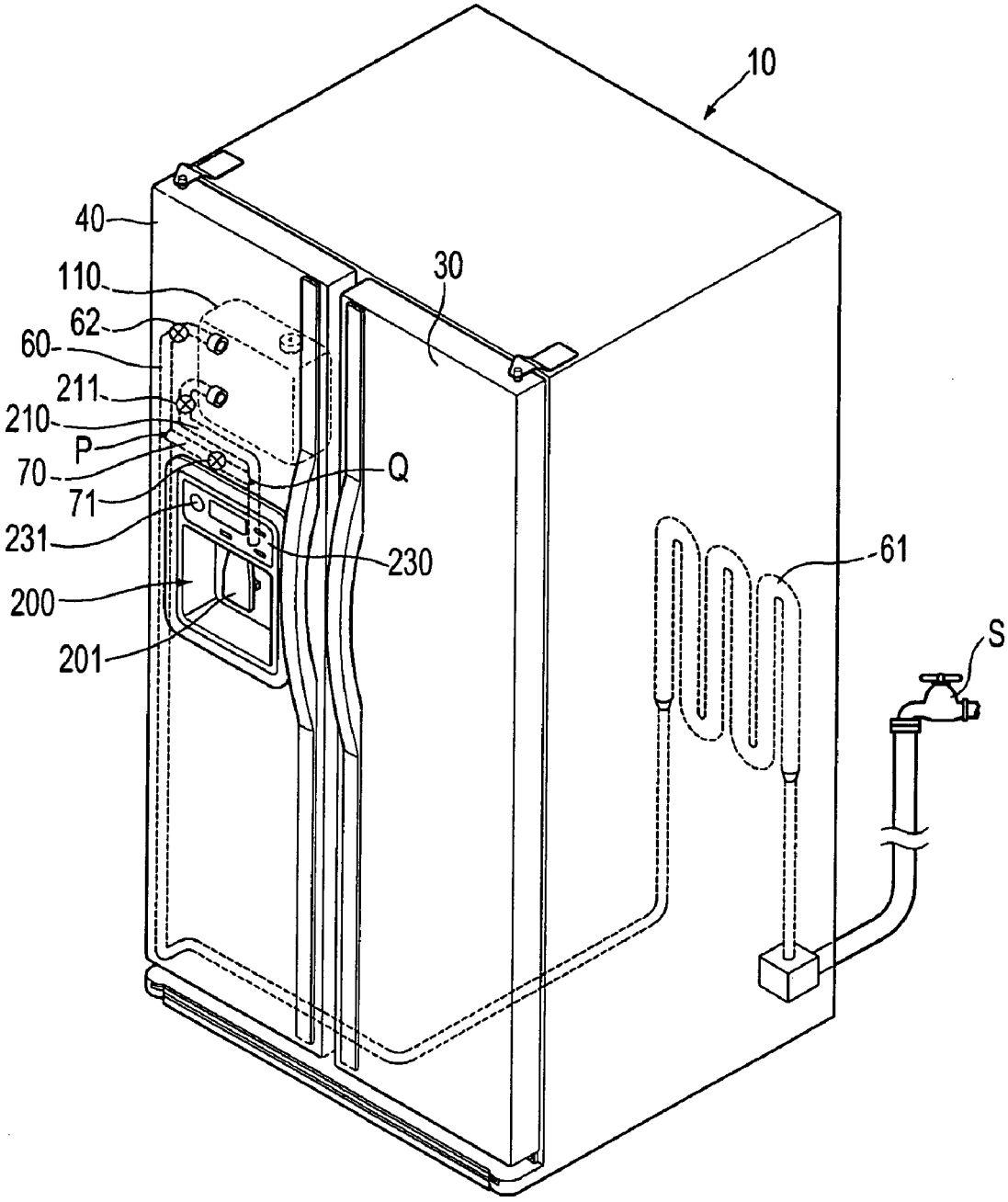
FIG. 1 is a perspective view illustrating a refrigerator according a first embodiment of the present invention.

Reference will now be made in detail to the embodiments of the present invention, examples of which are illustrated in the accompanying drawings. The embodiments are described below to explain the present invention by referring to the figures. FIG. 1 is a perspective view illustrating a refrigerator according a first embodiment of the present invention, FIG. 2 is a perspective view illustrating a supercooled liquid tank installed in a supercooling compartment of the refrigerator in FIG. 1, and FIG. 3 is a sectional view of the refrigerator when a door of a freezer compartment is closed taken along the line I-I.

Figure 2:
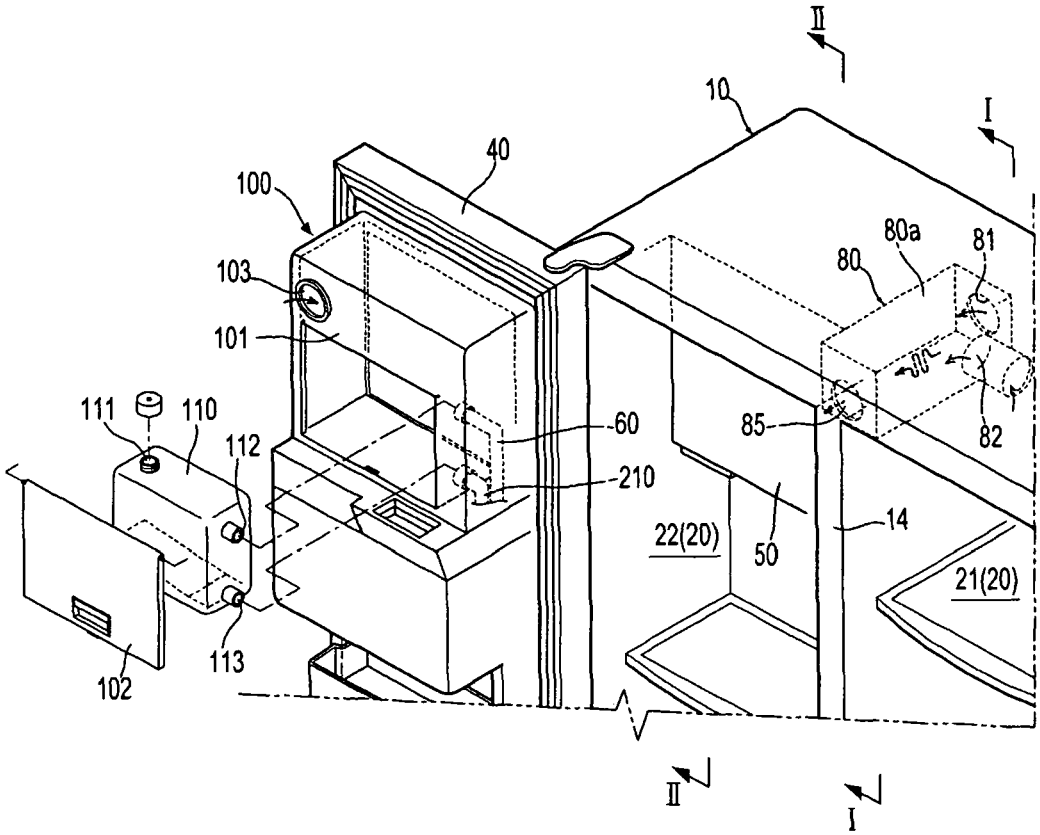
FIG. 2 is a perspective view illustrating a supercooled liquid tank installed in a supercooling compartment of the refrigerator in FIG. 1.
Figure 3:
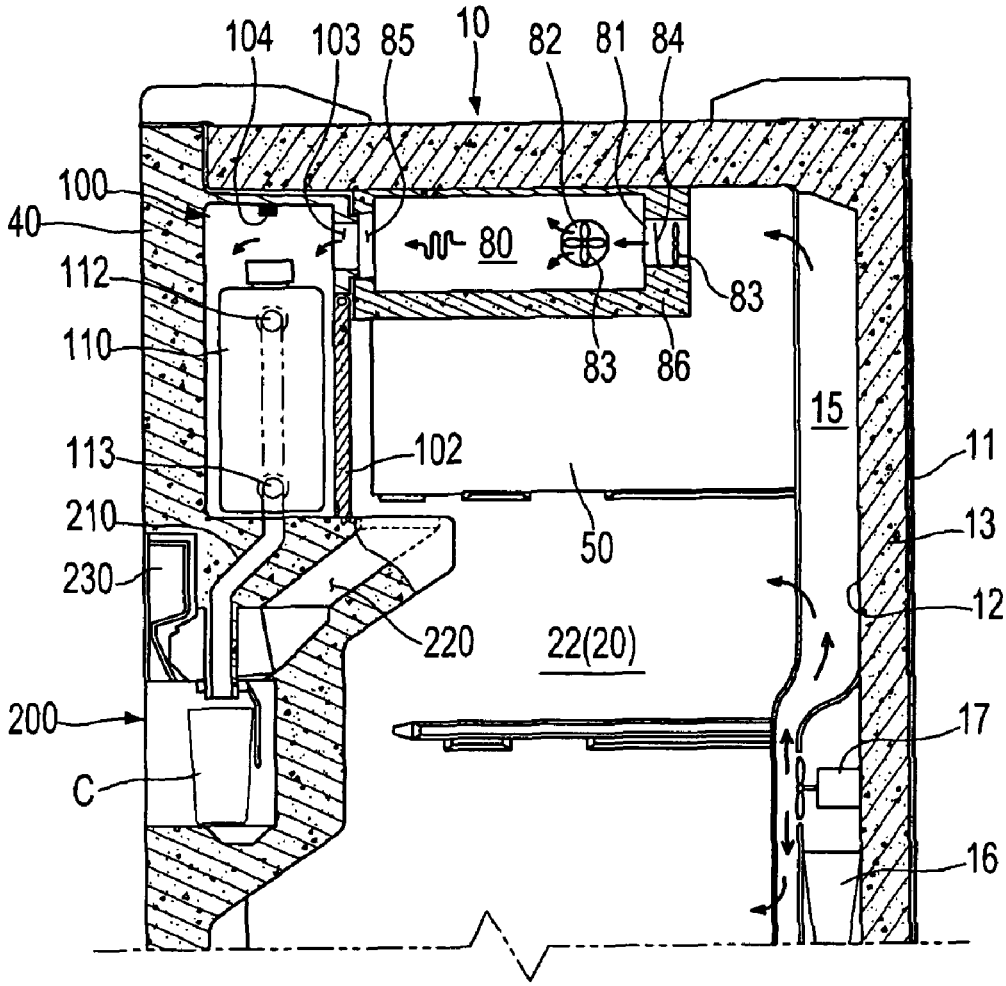
FIG. 3 is a sectional view of the refrigerator when a door of a freezer compartment is closed taken along the line I-I.

As shown in FIGS. 1 to 3, a refrigerator according to the first embodiment of the present invention includes compartments 20 for accommodating food and a main body 10 having doors 30 and 40 for opening and closing the compartments 20. The main body 10 includes an outer shell 11 for forming an outer appearance and an inner shell 12 spaced apart from the outer shell 11 to form the compartments 20. A foam insulator 13 is placed between the outer shell 11 and the inner shell 12 to prevent chilled air from leaking out of the refrigerator.

The compartments 20 are divided into a right room and a left room by an intermediate partition 14, where the right room forms a refrigerator compartment 21 for accommodating food and the left room forms a freezer compartment 22 for accommodating frozen food. In the rear side of the compartments 20, a chilled air generating room 15 is formed to generate the chilled air to be supplied to the compartments 20. In the chilled air generating room 15, an evaporator 16 is installed to generate the chilled air by performing heat-exchange with ambient air, and in the vicinity of the evaporator 16, a circulation fan 17 is installed to supply the chilled air to the compartments 20.

In particular, the refrigerator according to the first embodiment of the present invention includes a supercooling compartment 100, provided in the rear side of the freezer compartment door 40, where a beverage is supercooled, and a dispenser 200 installed in the front side of the freezer compartment door 40 to allow a user to receive a supercooled liquid generated in the supercooling compartment 100 without opening the freezer compartment door 40.

Here, the supercooling compartment 100 is similar to the freezer compartment 22 in view of accommodating food at temperatures below zero degrees, but is different from the freezer compartment 22 in view of being controlled to maintain a temperature range different from that of general freezer compartment and requiring a precise temperature control for stable supercooling of the beverage.

In the supercooling compartment 100, a supercooled liquid tank 110 is provided to accommodate the beverage in the supercooled state. The supercooled liquid tank 110, as shown in FIG. 2, may be detachably provided. Then, water and other various beverages such as juice can be supercooled and made into the slush beverages.

In the upper side of the supercooled liquid tank 110, a pouring opening 111 is formed for a user to supply various beverages therethrough, and in the upper side of the supercooled liquid tank 110, a supply port 112 is formed to receive water from an external water source S. Moreover, in the lower side of the supercooled liquid tank 110, a discharge port 113 is formed to discharge the supercooled liquid. The supply port 112 and the discharge port 113 are respectively connected to a first water supply pipe 60 and a supercooled liquid discharge pipe 210, described later, to be opened only when the supercooled liquid tank 110 is installed to the supercooling compartment 100, and to be automatically closed when the supercooled liquid tank 110 is separated from the first water supply pipe 60 and the supercooled liquid discharge pipe 210. Since this structure is conventional, its detailed description is omitted.

In the rear side 101 of the supercooling compartment 100, a supercooling compartment door 102 is installed to open and close the supercooling compartment 100 when attaching and detaching the supercooled liquid tank 110. The supercooling compartment door 102 is made of an insulator such that the supercooling compartment 100 is not affected by the temperature of the freezer compartment 22.

Figure 4:
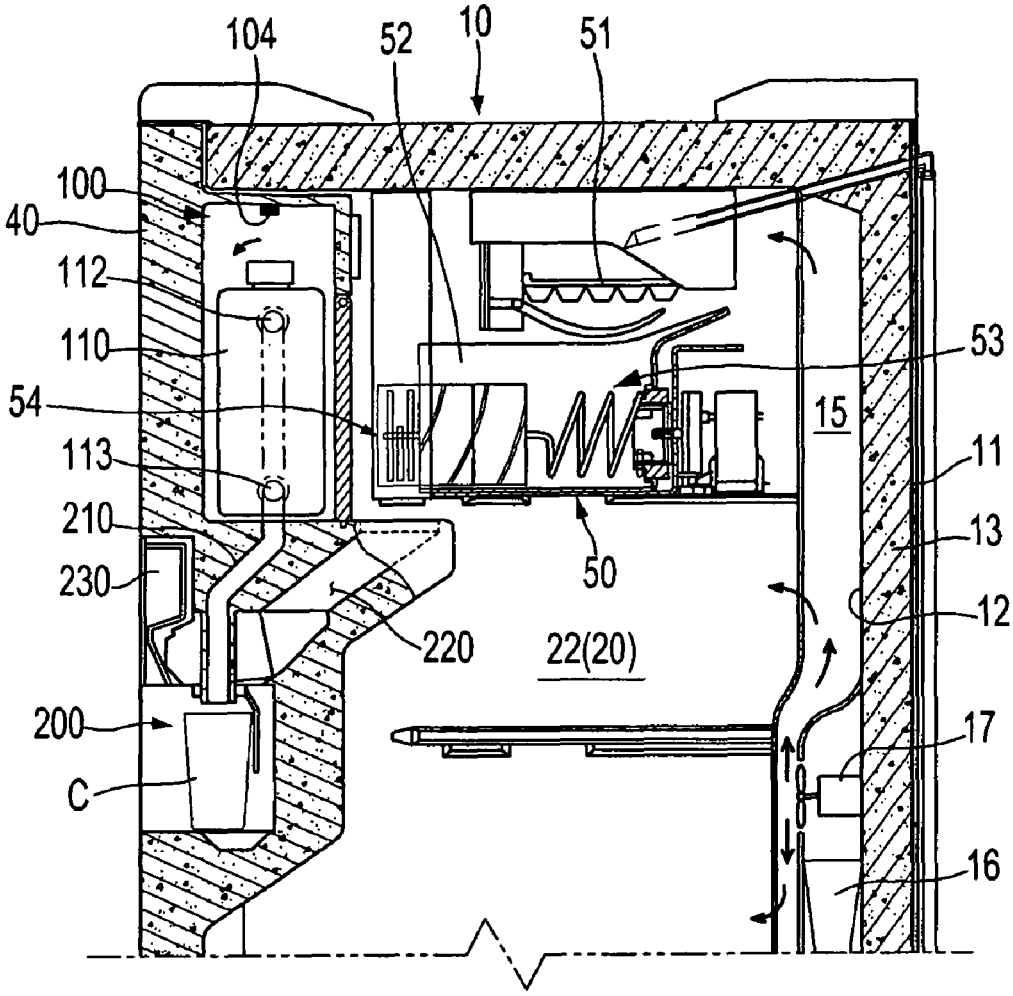
FIG. 4 is a sectional view of the refrigerator when a door of a freezer compartment is closed taken along the line II-II of FIG. 2 and illustrating an ice supplying device.

Meanwhile, the dispenser 200 is structured to allow the user to receive the supercooled beverage as well as water and ice. To this end, in the main body 10, an ice supply device 50 is installed. FIG. 4 is a sectional view of the refrigerator when a door of a freezer compartment is closed taken along the line II-II of FIG. 2 and illustrating an ice supplying device, and FIG. 5 is a perspective view illustrating a partial structure of the ice supplying device in FIG. 4.

Figure 5:
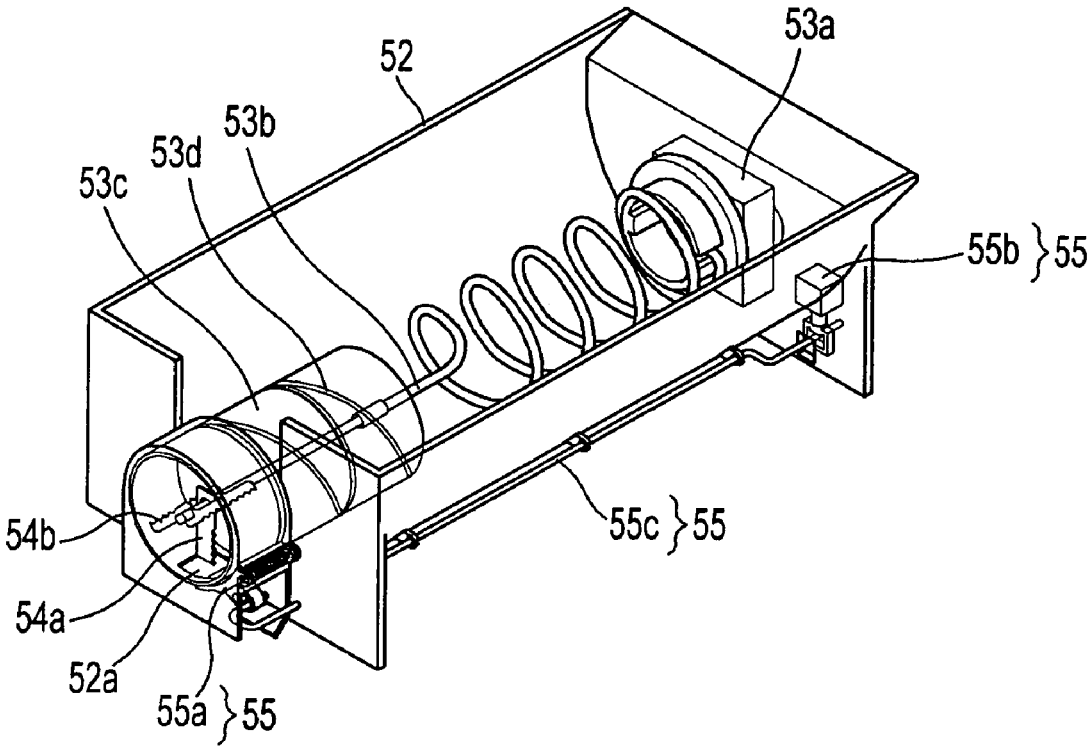
FIG. 5 is a perspective view illustrating a partial structure of the ice supplying device in FIG. 4.

As shown in FIGS. 4 and 5, the ice supply device 50 includes an icing unit 51 for generating ice cubes, an ice container 52 disposed in the lower side of the icing unit 51 to contain the ice cubes generated by the icing unit 51, a transfer unit 53 for transferring the ice cubes in the ice container 52, a shattering unit 54 for shattering the ice cubes transferred by the transfer unit 53 into ice segments, and a discharge unit 55 for selectively discharging the ice segments and the ice cubes.

The transfer unit 53 includes a driving motor 53*a*, a spiral shaft 53*b* rotated by the driving motor 53*a* to transfer the ice cubes, a guide vessel 53*c* for guiding the ice cubes, and a spiral blade 53*d* installed in the guide vessel 53*c* to push the ice cubes. The shattering unit 54 includes a fixed cutter 54*a* fixed to the exit 52*a* of the ice container 52 and a rotational cutter 54*b* for rotating with the spiral shaft 53*b* such that the ice cubes are interposed between the fixed cutter 54*a* and the rotational cutter 54*b* to be shattered when the rotational cutter 54*b* rotates. The discharge unit 55 includes an opening and closing member 55*a* rotatably installed to the exit 52*a* of the ice container 52, a driving device 55*b* for supplying a driving force necessary for rotating the opening and closing member 55*a*, and a connecting rod 55*c* for connecting the opening and closing member 55*a* to the driving device 55*b*.

Thus, when the driving device 55*b* is operated such that the opening and closing member 55*a* closes a part of the exit 52*a* of the ice container 52, since the ice cubes are interposed between the fixed cutter 54*a* and the rotational cutter 54*b* and shattered, the ice segments are discharged through the exit 52*a*. Otherwise, when the driving device 55*b* does not operate the opening and closing member 55*a* to fully open the exit 52*a* of the ice container 52, since the ice cubes are not interposed between the fixed cutter 54*a* and the rotational cutter 54*b*, the not-shattered ice cubes are discharged.

Moreover, as shown in FIGS. 1 to 3, the refrigerator of the present invention includes the supercooled liquid discharge pipe 210 for discharging the supercooled liquid accommodated in the supercooled liquid tank 110 to the dispenser 200, the first water supply pipe 60 for supplying water to the supercooled liquid tank 110, a second water supply pipe 70 in which an end thereof is communicated with the first water supply pipe 60 and the opposite end thereof extends toward the dispenser 200, and an ice taking-out pipe 220 for taking the ice supplied from the ice supply device 50 out of the main body 10.

The supercooled liquid discharge pipe 210 connects the discharge port 113 of the supercooled liquid tank 110 to the front external space of the door 40. The supercooled liquid discharge pipe 210 is also connected to the second water supply pipe 70 such that plain cool water is also supplied through the supercooled liquid discharge pipe 210.

The first water supply pipe 60 has an end communicated with the supply port 112 of the supercooled liquid tank 110 and the opposite end communicated with the water source S. The first water supply pipe 60 may include a pre-refrigerating part 61 provided in the rear side of the refrigerator compartment 21 to refrigerate water supplied from the water source S using the temperature difference between the temperature of the refrigerator compartment 21 and the temperature of water. Since water refrigerated by a predetermined degree of temperature is supplied to the supercooled liquid tank 110, time for preparing supercooled water in the supercooling compartment 110 can be reduced.

In the first water supply pipe 60, the second water supply pipe 70, and the supercooled liquid discharge pipe 210, a first water supply valve 62, a second water supply valve 71, and a discharge valve 211 are installed respectively to control opening and closing the pipes respectively. The first water supply valve 62 is installed downstream of a connection spot P where the second water supply pipe 70 is connected to the first water supply pipe 60, and the discharge valve 211 is installed upstream of a combining point Q where the second water supply pipe 70 meets the supercooled liquid discharge pipe 210.

Although in the above a structure in which the first water supply pipe 60 and the second water supply pipe 70 are installed such that water is supplied from the exterior, the user can directly supply water into the supercooled liquid tank 110 in a structure having only the supercooled liquid discharge pipe 210 without the first and second water supply pipes 60 and 70.

Meanwhile, in the dispenser 200, a taking-out lever 201 is installed to allow the user to take out at least one of water, the supercooled liquid, and ice, and a controlling unit 230 is installed to control operation of the refrigerator in relation to the dispenser 200. The controlling unit 230 includes a mode selector 231 for selecting an object to be taken out through the dispenser 200 by the user.

The user can manipulate the mode selector 231 to select a cool water mode, an ice mode, a supercooled liquid mode, or a slush mode. In the cool water mode, the ice mode, and the supercooled liquid mode, objects corresponding to the respective mode, that is, cool water, ice, or the supercooled liquid can be selectively taken out. The user can use both of the supercooled liquid mode and the ice mode or only the supercooled liquid mode to make the slush beverage.

In particular, the slush mode is a mode in which when the taking-out lever 201 is pressed the supercooled liquid and the ice are taken out together and a mode in which the supercooled liquid is directly changed into the slush within a cup. This is because, when voluminous ice such as an ice cube is used in the slush mode, the supercooled liquid may collide with the voluminous ice cubes and splash out during the supply of the supercooled liquid and the ice cubes and the beverage is diluted with melted ice so that the beverage is vapid. The controlling unit 230, therefore, in the slush mode, controls the discharge unit 55 (in more detail, the driving device 55*b*) of the ice supply device 50 such that the ice segments are discharged to the dispenser 200.

The controlling unit 230 opens the discharge valve 210 while closing the second water supply valve 71 in the supercooled liquid mode and the slush mode. In the cool water mode, the controlling unit 230 opens the second water supply valve 71 while closing the first water supply valve 62. As such, when the second water supply valve 71 is opened, water refrigerated in the pre-refrigerating part 61 passes through the first water supply pipe 60, the second water supply pipe 70, and the supercooled liquid discharge pipe 210 and is supplied to the dispenser 200 for the user.

Meanwhile, a structure for implementing a supercooling compartment 100 having a temperature range different from that of the freezer compartment 22 will be described as follows. The supercooling compartment 100 includes a chilled air introducing port 103 formed in the rear side 101 of the supercooling compartment 100 through which chilled air enters the supercooling compartment 100.

The lowest temperature in which the beverage can be supercooled (hereinafter referred to a 'limit supercooling temperature') is determined by variables such as type of the beverage, material or a size of a container for containing the beverage, and the like. However, when the types of the containers usually used are restricted to only a few, then material, size and other marginally effective variables (for example, refrigerating speed) are neglected, experimental data are statistically processed so that supercooling temperatures suitable for the types of the beverages can be determined. The experiments are performed while changing the types of the beverages as described above, proper temperature range of the supercooling compartment 100 is about –(minus) 5 degrees centigrade to –(minus) 12 degrees centigrade. Since the temperature range is between temperature (–(minus) 18 degrees centigrade to –(minus) 21 degrees centigrade) of the freezer compartment 22 and temperature (3 degrees centigrade to 5 degrees centigrade) of the refrigerator compartment 21, chilled air in the freezer compartment and chilled air in the refrigerator compartment are properly mixed with each other to make chilled air used to supercool the beverage.

Using the above point, the chilled air from the freezer compartment and the chilled air from the refrigerator compartment are properly mixed and supplied into the chilled air introducing port 103 so that a proper temperature required in the supercooling compartment 100 can be maintained. Thus, the refrigerator according to the first embodiment of the present invention includes a mixing room 80 for suctioning chilled air respectively from the freezer compartment 22 and the refrigerator compartment 21 and for mixing the same to make chilled air to be supplied into the supercooling compartment 100. The mixing room 80 is provided in the freezer compartment 22.

The mixing room 80 includes a first suction port 81 for suctioning the freezer compartment chilled air and a second suction port 82 for suctioning the refrigerator compartment chilled air. The first suction port 81 penetrates a side of a mixing room casing 80*a* for partitioning the mixing room 80 and the freezer compartment 22 and communicates with the freezer compartment 22, and the second suction port 82 penetrates the intermediate partition 14 and communicates with the refrigerator compartment 21. In the first and second suction ports 81 and 82, there are installed a blower fan 83 for supply a force necessary for suctioning the freezer compartment chilled air and the refrigerator compartment chilled air, and a flap 84 for opening and closing the first and second suction ports 81 and 82 according to whether the blower fan 82 is driven or not.

The mixing room 80 includes a chilled air discharge port 85 for discharging the mixed chilled air into the supercooling compartment 100. The chilled air discharge port 85 is formed in the front side of the mixing room 80 such that the chilled air discharge port 85 is communicated with the chilled air introducing port 103 when the freezer compartment door 40 is closed.

In the supercooling compartment 100, a temperature sensor 104 is installed to measure temperature of the supercooling compartment 100. This is to adjust the suctioning quantities of the freezer compartment chilled air and the refrigerator compartment chilled air by controlling the blower fan 83 based on the temperature of the supercooling compartment 100 measured by the temperature sensor 104.

Meanwhile, the mixing room 80 may include an insulator 86 for preventing the chilled air from leaking and the internal temperature of the freezer compartment 22 from affecting the mixing room 80.

Although as described above the supercooling compartment 100 is provided in the rear side of the freezer compartment door 40 and the mixing room 80 is provided in the freezer compartment so that the dispenser 200 is installed in the freezer compartment door 40, if necessary, the connection between the supercooling compartment 100 and the mixing room 80, the connection between the first water supply pipe 60 and the supercooled liquid tank 110, the passage structure of the supercooled liquid discharge pipe 210, and the passage structure of the ice taking-out pipe 220 may be modified so that positions of the supercooling compartment 100, the mixing room 80, and the dispenser 200 can be variously changed.

Figure 6:
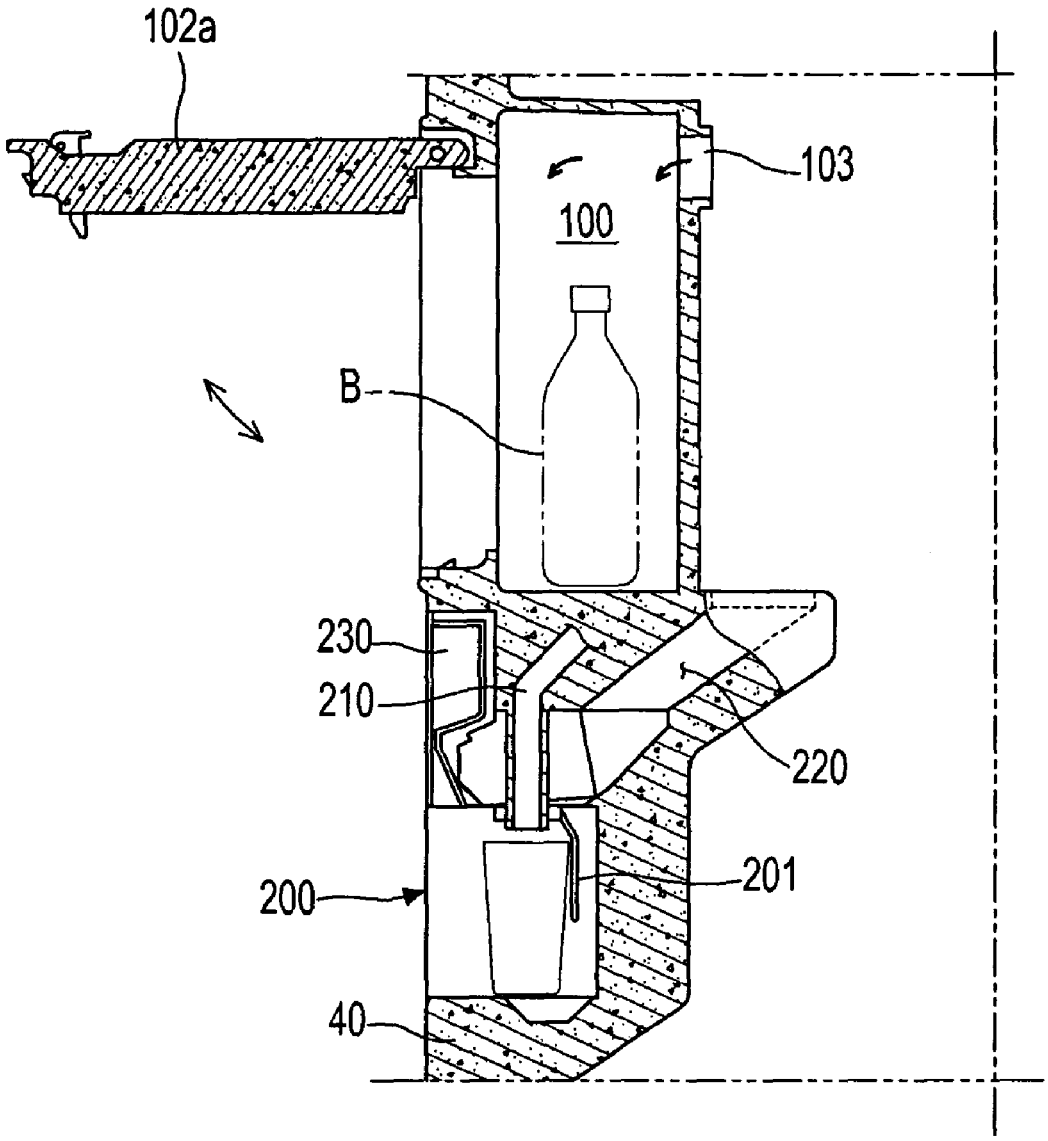
FIG. 6 is a side sectional view illustrating a supercooling compartment and a dispenser of a refrigerator according to a second embodiment of the present invention.

FIG. 6 is a side sectional view illustrating a supercooling compartment and a dispenser of a refrigerator according to a second embodiment of the present invention and the changed installation position of a supercooling compartment door.

As shown in FIG. 6, a supercooling compartment door 102*a* for opening and closing the supercooling compartment 100 may be installed in the front side of the freezer compartment door 40. Then, since the user opens only the supercooling compartment door 102*a* without opening the freezer compartment door 40 in order to attach and detach the supercooled liquid tank 110, loss of the chilled air can be reduced. Moreover, when the user removes the supercooled liquid tank 110 and uses the supercooling compartment 100, the user can make the slush by supercooling the beverage contained in a beverage container B. At this time, since the user puts in or takes out the beverage in the container B without opening the freezer compartment door 40, the slush beverage can be made conveniently. For this, the supercooling compartment 100 may have a sufficient size for accommodating the beverage container B in the supercooling compartment 100 when the supercooled liquid tank 110 is removed.

Figure 7:
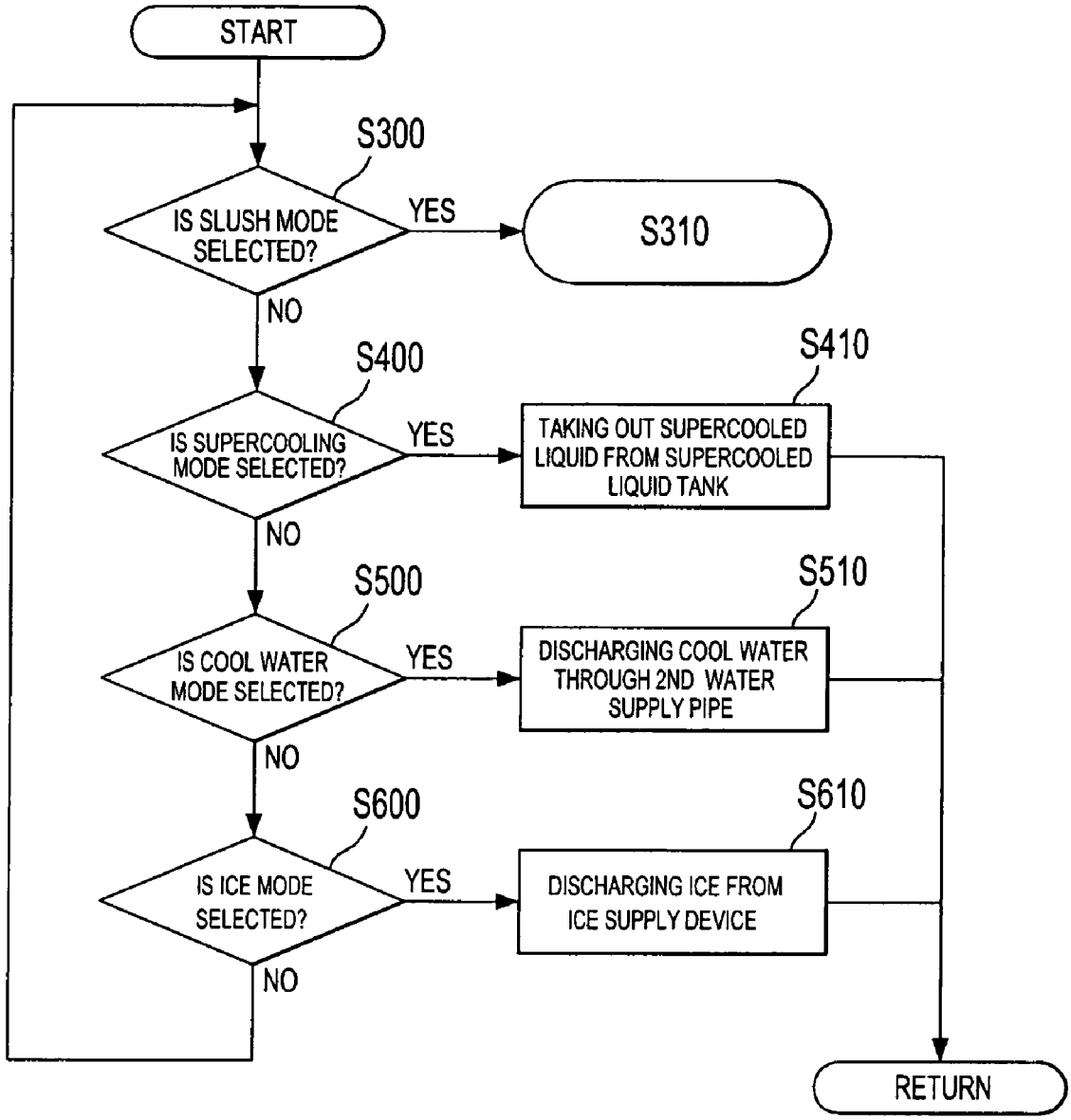
FIGS. 7, 8A and 8B are flowcharts illustrating a controlling method of the refrigerator according to the first embodiment of the present invention.
Figure 8A:
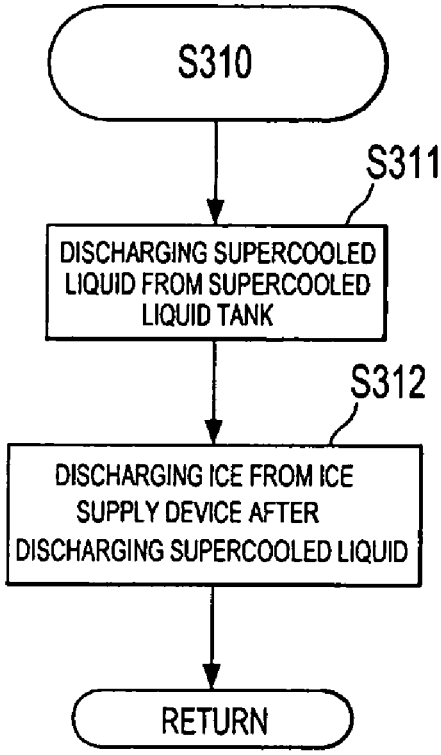
Figure 8B:
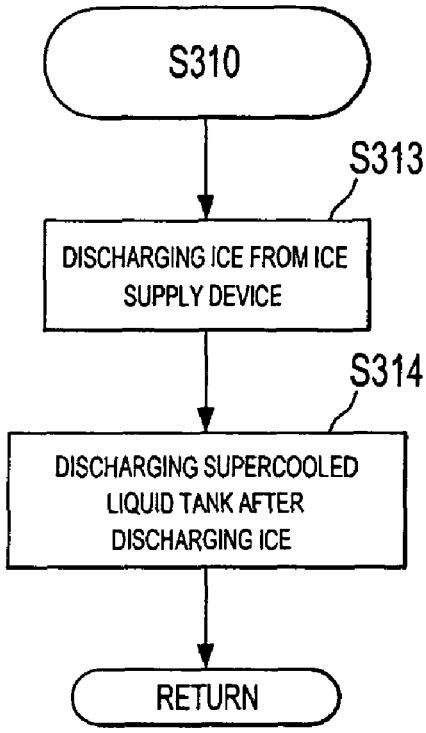

In relation to the aspects of the present invention, operation and the controlling method of the refrigerator according to the preferred embodiments of the present invention will be described as follows. FIGS. 7, 8A and 8B are flowcharts illustrating the controlling method of the refrigerator according to the first embodiment of the present invention.

The user selects and puts a beverage to be made into the slush beverage into the supercooled liquid tank 110 through the pouring opening 111 and mounts the supercooled liquid tank 110 in the supercooling compartment 100. When the user wants to make water into the slush beverage, water may be automatically supplied to the supercooled liquid tank 110 when the supercooled liquid tank 110 is installed in the supercooling compartment 100. The beverage in the supercooled liquid tank 110 is supercooled into the supercooled liquid in the supercooling compartment 100. The temperature required to refrigerate beverage without being frozen is controlled by controlling rotation speed of the blower fan 83 in the mixing room 80 based on temperature detected by the temperature sensor 104 in the supercooling compartment 100.

As shown in FIGS. 7, 8A and 8B, the user can receive the supercooled liquid through the dispenser 200 without opening the freezer compartment door 40 to make the slush beverage. Like the conventional refrigerator, the user can take out cool water and ice through the dispenser 200. Hereinafter, a controlling method of the refrigerator in relation to operation of the dispenser 200 on the assumption of operating the taking-out lever 201 after the selection of the modes by the user will be described.

When the user selects a mode using the mode selector 231, the controlling unit 230 determines which mode is selected among the slush mode, the supercooled liquid mode, the cool water mode, and the ice mode by the user (S300, S400, S500, and S600). When the user selects the slush mode, the controlling unit 230 opens the discharge valve 211 such that the supercooled liquid is discharged from the supercooled liquid tank 110 (S311, and see FIG. 8A). After the discharge of the supercooled liquid from the supercooled liquid tank 110, the controlling unit 230 controls the ice supply device 50 such that ice is discharged from the ice supply device 50 (S312, and see FIG. 8A). Then, the discharged ice serves as an ice nucleus for changing the supercooled liquid in a cup C into the slush instantaneously. That the supercooled liquid and the ice are discharged at a time interval as described above, is to prevent the supercooled liquid from being changed into the slush when the supercooled liquid meets the ice during the discharge. Thus, as shown in FIG. 8B, it is possible that the ice is discharged first (S313) and, after that, the supercooled liquid is discharged (S314).

Moreover, when the user selects the supercooled liquid mode, the controlling unit 230 opens the discharge valve 211 such that the supercooled liquid is discharged from the supercooled liquid tank 110 (S410). As such, when the supercooled liquid mode is used, the user takes out the ice by selecting the ice mode again to make the supercooled liquid into the slush. Moreover, the user can receive the discharged supercooled liquid with a cup refrigerated for a predetermined time to make the slush.

In addition, when the user selects the cool water mode, the controlling unit 230 opens the second water supply valve 71 to allow the user to receive the cool water (S510). Finally, when the ice mode is selected, the controlling unit 230 controls the ice supply device 50 such that ice is discharged from the ice supply device 50 (S610).

Meanwhile, as shown in FIG. 6, in a case of installing the supercooling compartment door 102*a* in the front side of the freezer compartment door 40, the beverage container B containing the beverage is put in the supercooling compartment 100 without the supercooled liquid tank 110 and the beverage is supercooled so that the user can make the slush without using the dispenser 200.

Figure 9:
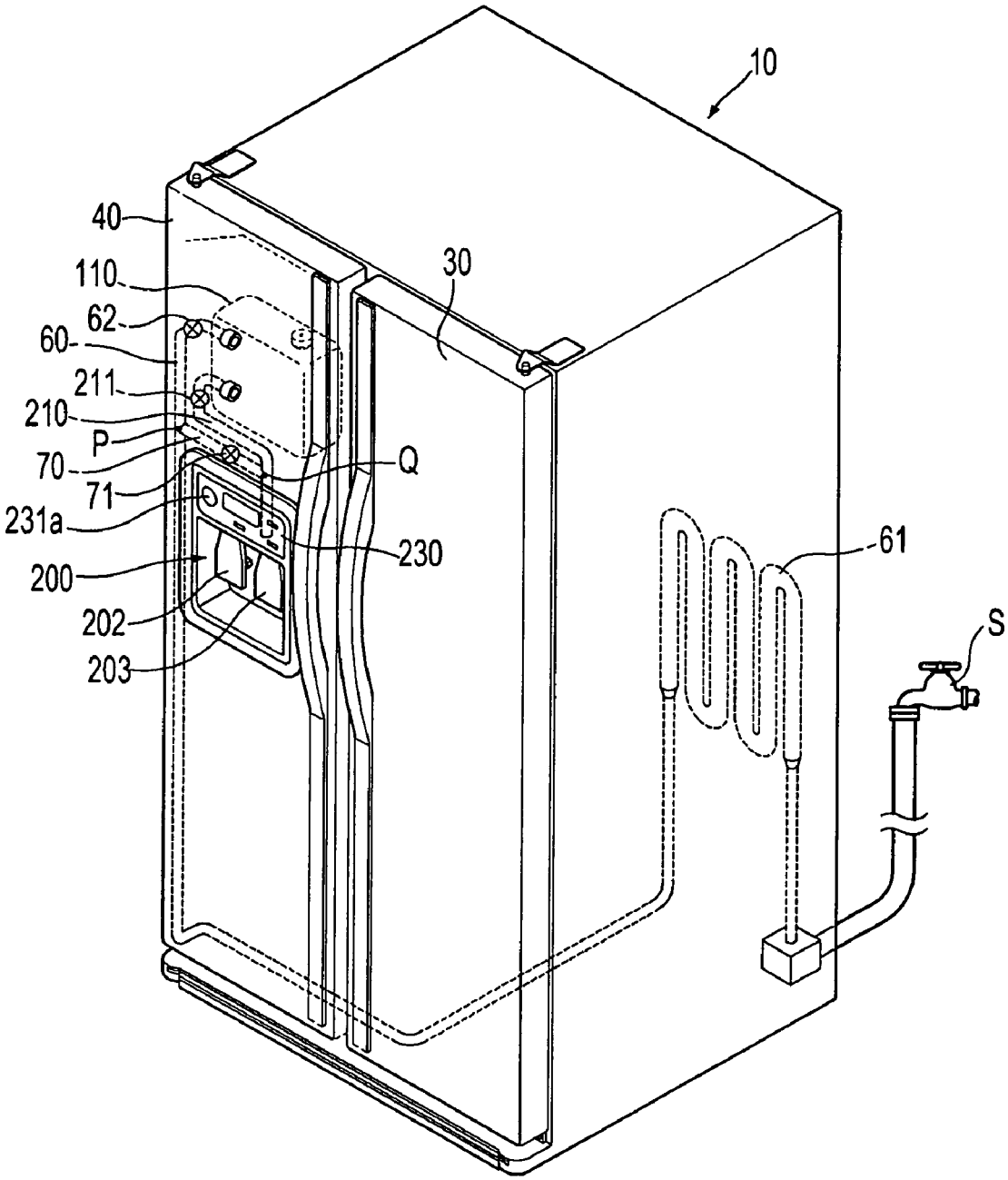
FIG. 9 is a perspective view illustrating a refrigerator according to a preferred embodiment of the present invention.
Figure 10:
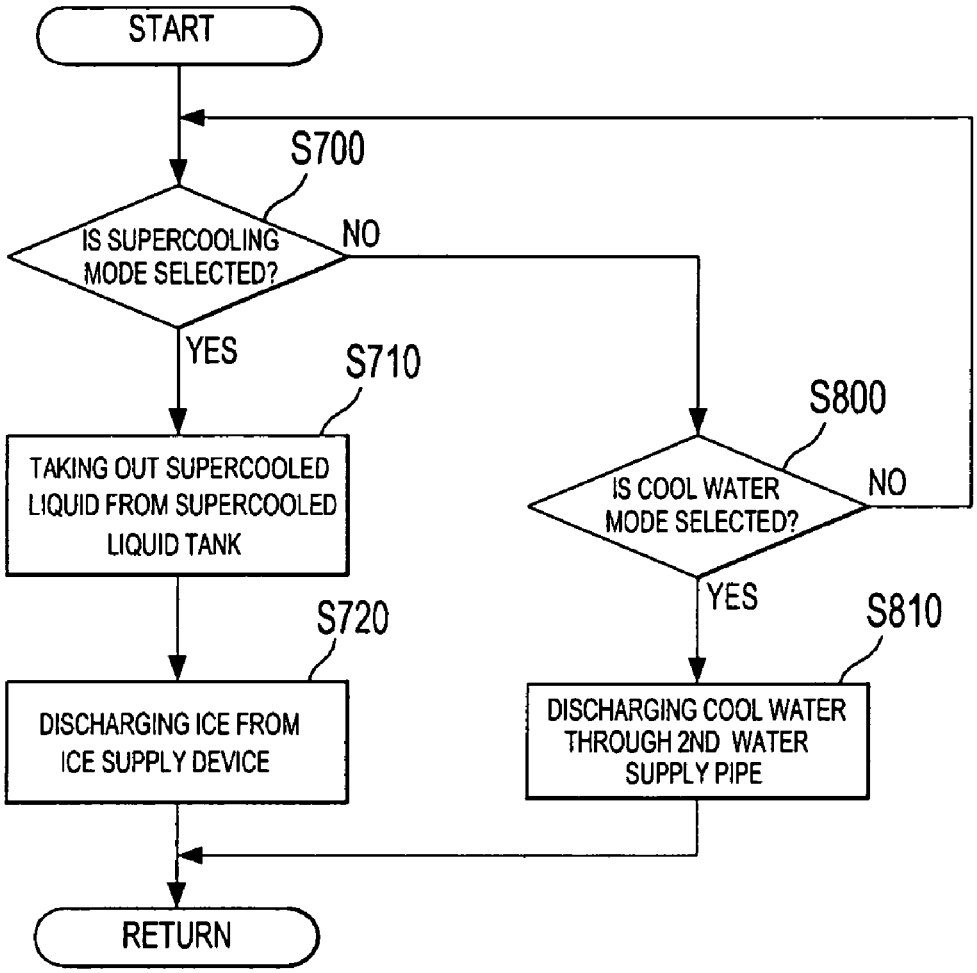
FIG. 10 is a flowchart illustrating a controlling method of a dispenser as shown in the refrigerator in FIG. 9.

FIG. 9 is a perspective view illustrating a refrigerator according to a third embodiment of the present invention, and FIG. 10 is a flowchart illustrating a controlling method in relation to a dispenser as shown in the refrigerator in FIG. 9. As shown in FIG. 9, the dispenser 200 of the refrigerator according to the third embodiment of the present invention includes a first lever 202 for taking out water and the supercooled liquid toward the dispenser 200 and a second lever 203 for taking out ice from the ice supply device 50.

In this case, a mode selector 231*a* is provided to select material discharged during the operation of the first lever 202, and the user can select the supercooled liquid mode and the cool water mode using the mode selector 231*a*. As shown in FIG. 10, when the user selects a mode using the mode selector 231*a*, the controlling unit 230 determines that either the supercooled liquid mode or the cool water mode is selected (S700 and S800). When the user selects the supercooled liquid mode and the first lever 202 is pressed, the controlling unit 230 controls the discharge valve 211 such that the supercooled liquid is discharged from the supercooled liquid tank 110 (S710). After that, the user presses the second lever 203 (in other words, according to a command from the user) to receive ice from the ice supply device 50 so that the user can make the supercooled liquid into the slush (S720). Meanwhile, when the user selects the cool water mode, the controlling unit 230 opens the second water supply valve 71 such that the user can receive the cool water through the second water supply pipe 70 (S810).

Figure 11:
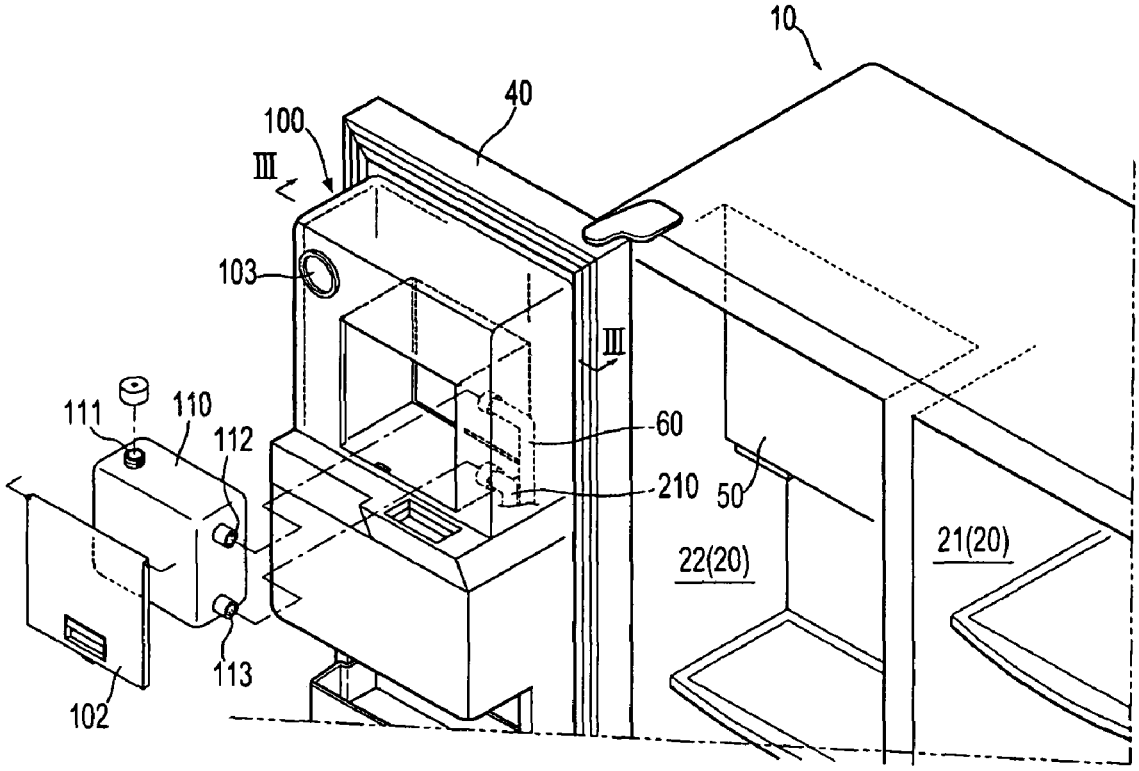
FIG. 11 is a perspective view illustrating the installation of a supercooled liquid tank in a supercooling compartment of a refrigerator according to a fourth embodiment of the present invention.
Figure 12:
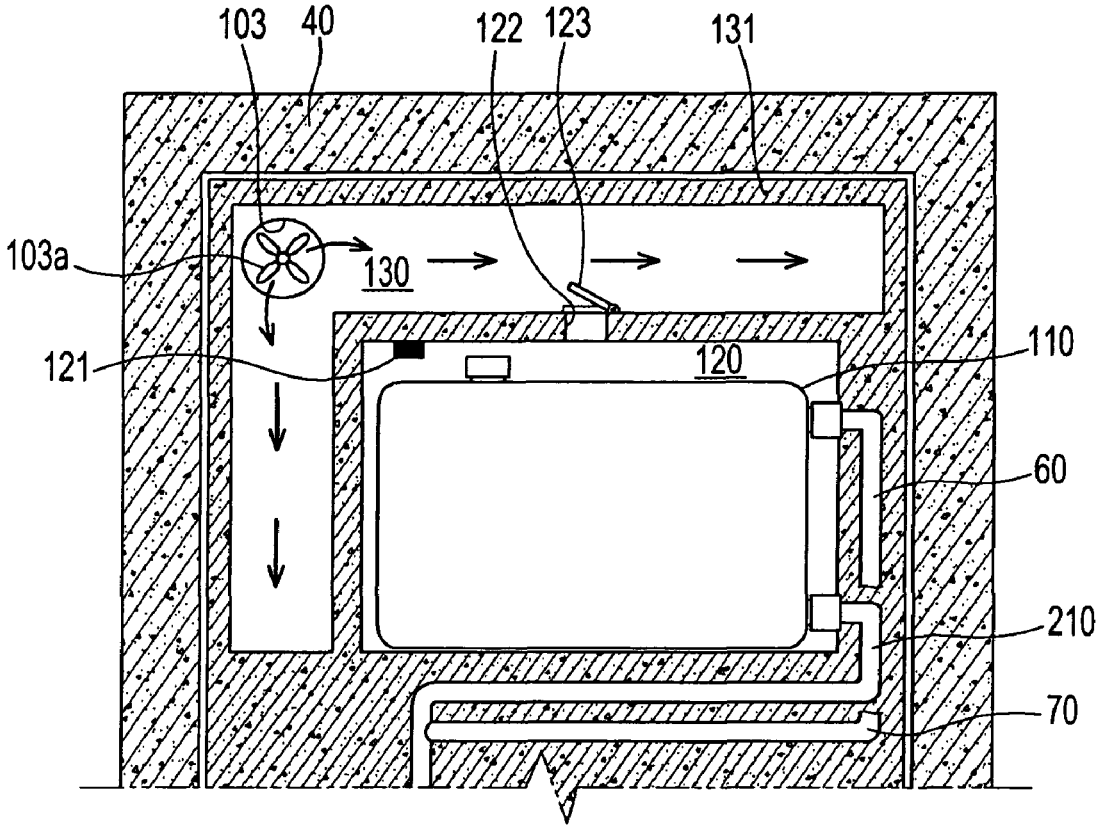
FIG. 12 is a sectional view taken along the line III-III in FIG. 11 and illustrating the supercooling liquid tank installed in the refrigerator in FIG. 11.

FIG. 11 is a perspective view illustrating the installation of a supercooled liquid tank in a supercooling compartment of a refrigerator according to a fourth embodiment of the present invention, and FIG. 12 is a sectional view taken along the line III-III in FIG. 11 and illustrating the supercooling liquid tank installed in the refrigerator in FIG. 11. In FIGS. 11 and 12, the same components are assigned with the same reference numerals. In this preferred embodiment, in comparison to the embodiment as shown in FIG. 3, there is a difference of refrigerating the supercooling compartment 100. Hereinafter, only specific features of this embodiment will be described.

As shown in FIGS. 11 and 12, the supercooling compartment 100 includes an accommodating room 120 for accommodating the supercooled liquid tank 110 and a chilled air circulation room 130 disposed outside the accommodating room 120 and having the chilled air introducing port 103. Due to this structure, the beverage in the supercooled liquid tank 110 is indirectly refrigerated by the chilled air in the freezer compartment 22. In other words, the chilled air in the freezer compartment 22 is not directly blown into the supercooled liquid tank 110, but refrigerates the accommodating room 120 through heat transfer such as conduction and radiation of the chilled air introduced into the chilled air circulation room 130. Then, local or rapid temperature change of the beverage that may occur when the chilled air is directly supplied into the supercooled liquid tank 110 can be mitigated.

In the chilled air introducing port 103, there are installed a blower fan 103*a* for supplying a suction force necessary for suctioning the freezer compartment chilled air, and a flap (not shown) for opening and closing the chilled air introducing port 103 according to whether the blower fan 103*a* is driven or not. In the accommodating room 120, a temperature sensor 121 is installed such that the blower fan 103*a* is controlled based on the temperature of the accommodating room 120 detected by the temperature sensor 121 to adjust the suctioned quantity of the freezer compartment chilled air.

Meanwhile, when the beverage of room temperature is placed in the accommodating room 120 and it begins to refrigerate the same, the chilled air is directly supplied into the accommodating room 120 for a predetermined time to rapidly refrigerate the beverage rather than using the indirect refrigerating method as described above. Thus, the accommodating room 120 may include a chilled air injection port 122 communicated with the chilled air circulation room 130 such that the chilled air is directly delivered from the chilled air circulation room 130 into the accommodating room 120 and a damper 123 for opening and closing the chilled air injection port 122.

Meanwhile, the chilled air circulation room 120 has an insulator 131 for preventing effect from the inner temperature of the freezer compartment 22 by preventing the chilled air from leaking.

As described above, according to the present invention, the user can conveniently make as much as slush as the user wishes without opening the refrigerator door. The loss of the chilled air occurring whenever the user opens the refrigerator door to take out the supercooled beverage can be prevented, so that temperature of the supercooling compartment for supercooling the beverage is easily controlled.

Although a few embodiments of the present invention have been shown and described, it would be appreciated by those skilled in the art that changes may be made in this embodiment without departing from the principles and spirit of the invention, the scope of which is defined in the claims and their equivalents.

What is claimed is:

1. A controlling method of a refrigerator for supercooling a beverage or liquid, the refrigerator including a supercooling compartment to supercool a liquid, an ice supply device to supply ice, and a dispenser to dispense the liquid and ice without opening a door of the refrigerator, comprising:

selecting a slush mode according to a command by the user; and making a slush by taking out a supercooled liquid in the supercooling compartment and ice according to the selected slush mode.

2. The controlling method of a refrigerator for supercooling a beverage according to claim 1, wherein the making the slush comprises taking out the supercooled liquid from the supercooling compartment and taking out the ice from the ice supply device after taking out the supercooled liquid.

3. The controlling method of a refrigerator for supercooling a beverage according to claim 1, wherein the making the slush comprises taking out the ice from the ice supply device and taking out the supercooled liquid from the supercooling compartment after taking out the ice.

4. A controlling method of a refrigerator for supercooling a beverage or a liquid, the refrigerator including a supercooling compartment to supercool a liquid, an ice supply device to supply ice, and a dispenser to dispense the liquid and ice without opening a door of the refrigerator, comprising:

selecting a slush mode according to a command by the user;

taking out a supercooled liquid from the supercooling compartment according to the selected slush mode; and making a slush by taking out ice from the ice supply device according to the command by the user.

* * * * *